US005313775A

United States Patent [19]

Binder et al.

[11] Patent Number: 5,313,775

[45] Date of Patent: May 24, 1994

[54] APPARATUS AND METHOD FOR AUTOMATIC THREAD JOINING AND CLEANING IN A SPINNING MACHINE

[75] Inventors: Rolf Binder, Raterschen; Martin Witschi, Schaffhausen, both of Switzerland

[73] Assignee: Maschfnenfabrik Rieter AG, Winterthur, Switzerland

[21] Appl. No.: 728,555

[22] Filed: Jul. 11, 1991

[30] Foreign Application Priority Data

Jul. 20, 1990 [CH] Switzerland ..... 02422/90

[51] Int. Cl.[5] ..... D01H 13/26; D01H 9/00

[52] U.S. Cl. ..... 57/280; 57/261; 57/278; 57/305

[58] Field of Search ..... 57/261, 278, 280, 304, 57/305

[56] References Cited

U.S. PATENT DOCUMENTS

| | | | |
|---|---|---|---|
| 3,695,017 | 10/1972 | Hori et al. | 57/305 X |
| 4,127,983 | 12/1978 | Munker | 57/305 X |
| 4,176,514 | 12/1979 | Stalder | 57/304 X |
| 4,517,794 | 5/1985 | Sakai et al. | 57/304 |
| 4,619,109 | 10/1986 | Suzuki et al. | 57/261 |
| 4,893,461 | 1/1990 | Artzt et al. | 57/280 X |
| 5,070,688 | 12/1991 | Kato et al. | 57/304 |
| 5,090,189 | 2/1992 | Wey et al. | 57/279 X |
| 5,119,996 | 6/1992 | Stahlecker | 57/279 X |

FOREIGN PATENT DOCUMENTS

| | | | |
|---|---|---|---|
| 402191 | 2/1992 | Fed. Rep. of Germany | 57/304 |
| 4-002829 | 1/1992 | Japan | 57/280 |

*Primary Examiner*—Joseph J. Hail, III
*Assistant Examiner*—William Stryjewski
*Attorney, Agent, or Firm*—Wolf, Greenfield & Sacks

[57] ABSTRACT

In a textile spinning machine, apparatus for automatically joining a thread and cleaning the machine comprising a tube mechanism, a mechanism for routing a flow of air through the tube mechanism and controlling the rate of air flow through the tube mechanism; a mechanism for sequentially moving the tube mechanism to one or more selected thread joining positions relative to the machine including at least a position such that a thread end may be received and held within the tube mechanism via air suction flow through the tube mechanism; a mechanism for sequentially moving the tube mechanism to one or more selected thread waste positions relative to the machine such that the selected thread waste positions on the machine may be cleaned via controlled air flow through the tube mechanism; and wherein the mechanism for routing and controlling the air flow includes a mechanism for selectively adjusting the rate of air flow through the tube mechanism to a rate selected according to the selected position to which the tube mechanism is moved by the mechanism for moving.

33 Claims, 2 Drawing Sheets

APPARATUS AND METHOD FOR AUTOMATIC THREAD JOINING AND CLEANING IN A SPINNING MACHINE

BACKGROUND OF THE INVENTION

The present invention relates to mechanisms for piecing, spinning on, start spinning and cleaning apparatuses for use in conjunction with machines for spinning staple fiber bundles or slivers into a spun yarn and, more particularly, to a single mechanism for sequentially carrying out all such operations.

DE-PS 33 36 294 describes an automatic piecing apparatus which patrols in front of a row of spinning units of a spinning machine and has a manipulator, which, with a program controlled movement of a suction pipe, catches a thread to be joined and subsequently introduces the thread to the piecing operation.

In EP-A 259 622 there is described a programmable robot which travels at periodic intervals from spinning unit to spinning unit and sucks off fiber residues from critical points of the spinning machine with a suction pipe discharge during the operation of the spinning units. This device has the disadvantage that the cleaning effectiveness is insufficient at some points and is very expensive to manufacture.

SUMMARY OF THE INVENTION

In accordance with the invention there is provided a device and a method for cleaning and carrying out piecing operations in simple and effective fashion in a textile spinning machine.

BRIEF DESCRIPTION OF THE DRAWINGS

Following is a description of the invention by reference to preferred embodiments as depicted for example in the Figures wherein.

DETAILED DESCRIPTION OF PREFERRED EMBODIMENTS

Figure 1:
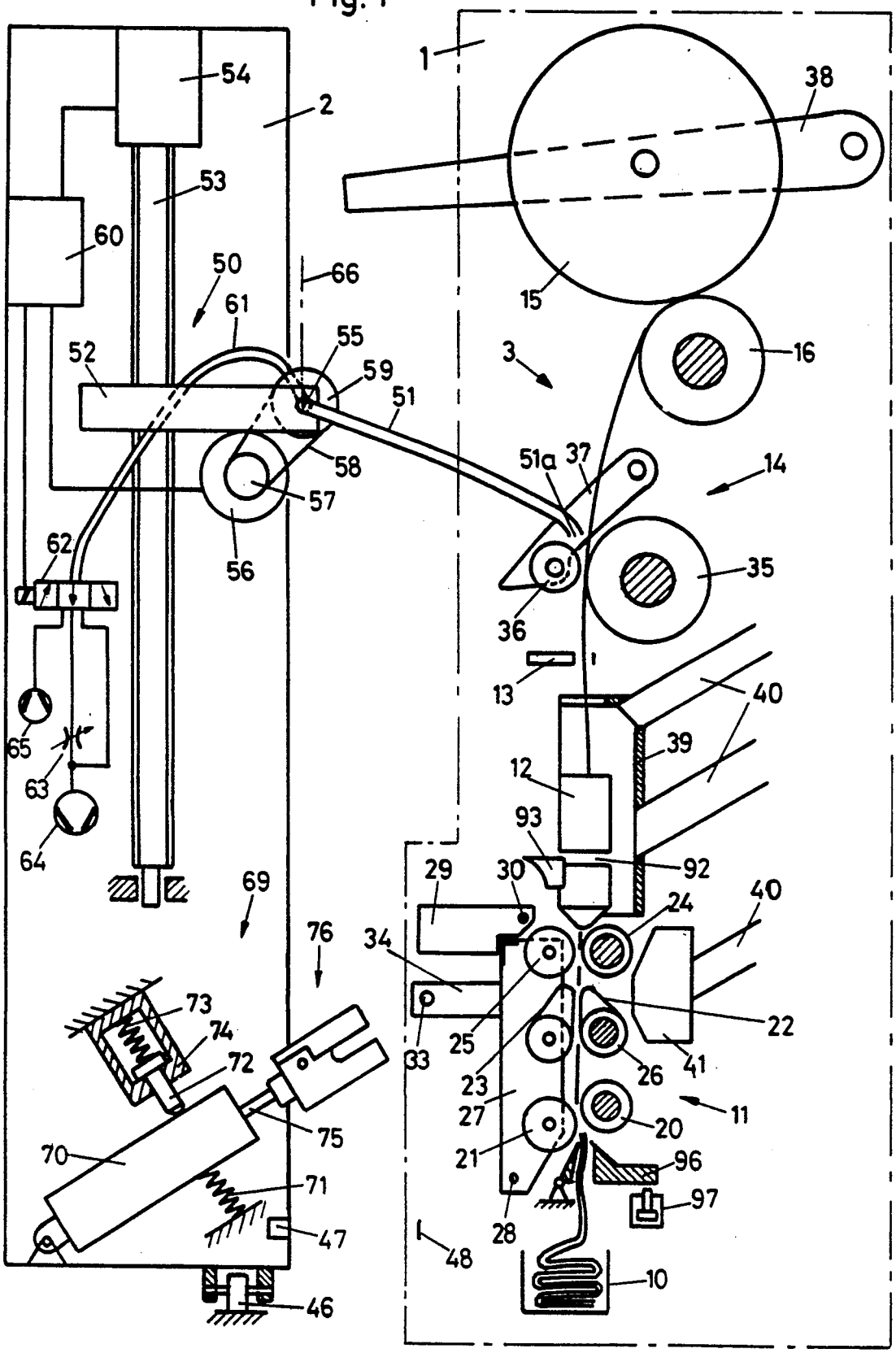
FIG. 1 is a schematic cross section through a spinning station in an air jet spinning machine and an associated automatic servicing robot or tender.

There is shown in FIG. 1, in cross section, a spinning machine 1 and an automatically operating servicing or tender device 2 mounted on the machine 1. The spinning machine 1 typically comprises a plurality of identical spinning units 3 typically arranged side by side along the length of the machine 1. As shown in the side view of FIG. 1, each spinning unit 3 includes a fiber sliver holder 10, a drafting arrangement 11, an air jet spinning nozzle 12, a thread detector 13, a pair of rollers for delivering a broken thread end 14 and a spool 15, which engages a drive roller 16 during operation. A drafting arrangement 11 typically comprises a pair of back entry rollers 20, 21, drafting aprons 22, 23 and a front pair of outlet or sliver delivery rollers 24, 25. The apron 22 is typically driven via a driven roller 26. The rollers 21, 25 and the apron 23 are mounted on a common rocking lever 27 and pressed resiliently against the rollers 20, 24 or the apron 22 during spinning operations. The lever 27 swivels or pivots on an axis or point 28 rigidly fitted or mounted in the machine housing and is held by a pawl 29 in an operating position as shown in FIG. 1. The pawl 29 swivels on a rigid axis or pivot point 30 mounted on the housing and engages, via a rear catch surface 31, FIG. 2, with a shoulder 32, FIG. 3, of the lever 27 to maintain the lever 27 in an upright position whereby the rollers 21, 25 and apron 23 are pressed against rollers 20, 24 and apron 22. The pawl 29 is swingable upwards out of engagement with lever 27 for enabling cleaning and servicing of the drafting arrangement 11. The lever 27 can be swung or pivoted outwardly on the axis 28 by means of a horizontal pin 33 as described below. The pin 33 is mounted on an arm 34 protruding from the lever 27 underneath the pawl 29.

A pair of draw-off rollers 14 is provided and comprise a driven draw-off roller 35 and a pressure roller 36 which may be pressed resiliently against roller 35, the roller 36 being pivotably movable out of engagement with roller 35 by virtue of its being mounted on a rocking lever 37. The bobbin 15 is pivotably movable into and out of engagement with roller 16 by virtue of its being mounted on a further swinging or rocking lever 38. The rollers 20, 24, 26, 35 and 16 are typically mounted on drive shafts which run the length of the spinning machine and are typically common to all spinning stations or units 3. The air jet nozzle 12 is typically surrounded by a housing open toward the front. Two suction pipes 40 merge into the housing surrounding the nozzle 12, through which, in operation, any fly which has not been spun is sucked out. A further fly or debris suction housing 41 with a further suction pipe 40 is typically arranged behind the drafting aprons 22 and the outlet or sliver delivery rollers 24.

The automatic device or robot 2 is movable on rollers 46 along the spinning machine 1 and may be aligned with station 3, for example, by means of a light detector 47, interacting with light beam reflector or generator 48, to align the robot 2 in front of the spinning unit 3 to be serviced. The automatic device 2 includes a manipulator 50 for moving a suction pipe 51 through several degrees of freedom. In the embodiment according to FIG. 1, only two degrees of freedom are shown and described for the sake of clarity. A sliding carriage 52 can be moved (in a first degree of freedom) vertically approximately parallel to the spinning axis (the axis of nozzle 12) by means of and along a threaded spindle or screw 53. The spindle 53 is rotatably drivable by a servomotor 54. The suction pipe 51 is pivotable on the carriage 52 around horizontal axis or pivot point 55 (in a second degree of freedom). The swivelling or pivoting movement of tube 51 is controllable via servomotor 56 and a conventional toothed belt 58 and associated gear units 57, 59. The two servomotors 54, 56 are automatically controllable via a programmable control unit 60. The suction pipe 51 is connected via a hose 61 with a three way valve 62, which is, in turn, automatically controlled from the control unit 60. In a first normal position of the valve 62, the hose 61 is connected through an adjustable shutter 63 to a suction pump 64. In a second position, the hose 61 is connected directly to the pump 64 and in a third position, to a source of pressurized air 65. The suction pipe 51 may also be rendered swivelable or pivotable in a third degree of freedom around a vertical axis 66 by means of a further servomotor, not shown.

As described below, in addition to performing cleaning operations, the suction pipe 51 is provided, in part, for receiving a broken thread end picked up from spool or bobbin 15 and typically further manipulating the thread end during piecing or joining operations. When the suction pipe 51 is connected with the pump 64 in its first and second positions, various means of discharging fiber fly or debris from the suction system 51, 61, 62, 63, 64, may be employed to prevent the fibers from reaching the pump 64. A first method comprises disposing a filter (not shown) within the suction system such as between the control valve 62 and the rear end of the suction pipe 51. The filter can be mechanically cleaned by hand or automatically at regular predetermined intervals or the accumulated fibers or fly can be returned to the staple fiber sliver bundle to be spun in the preparatory process through a directed blowing cycle utilizing the source of pressurized air 65 via the third valve position. If the fiber fly is not usable for further processing in the spinning process, then it can be blown into a storage tank.

Removal of the fibers or fly sucked out by the nozzle could alternatively be effected through the use of a injector (not shown), which has a continuous suction conduit with one or more air holes entering the suction conduit at an inclined angle to the axis of the conduit through which pressurized air is injected. By use of the suction, the fibers could be sucked or routed into a storage tank. The storage tank can also be arranged to empty automatically if desired, for example, by automatic inclination of the floor of the storage tank whereby the fly or debris collected is routed to a disposal apparatus. A full storage tank could alternatively be automatically replaced by an empty tank, which is typical in connection with a draw frame, for example.

Figure 2:
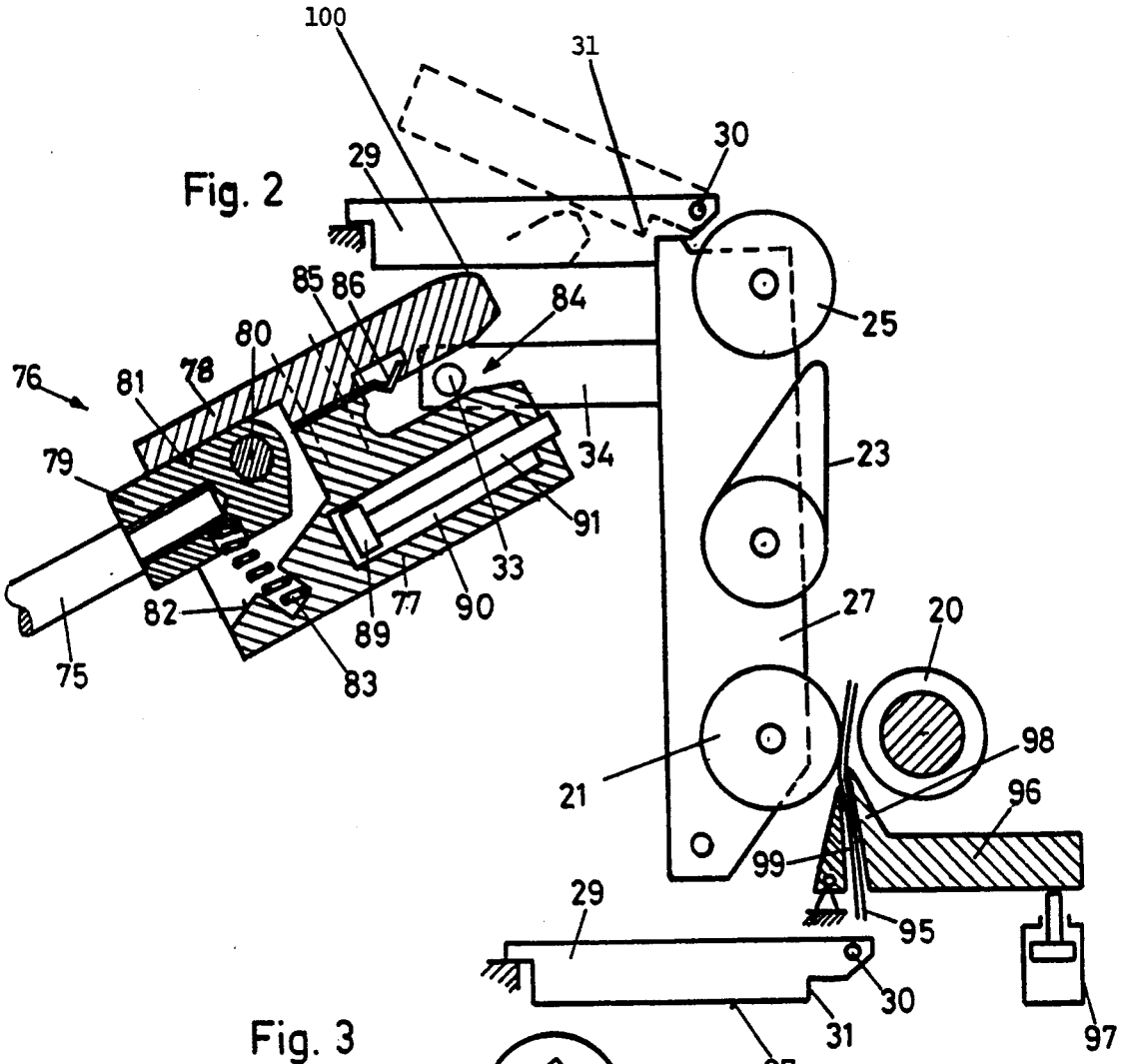
FIGS. 2, 3 are schematic cross sections of the subassemblies shown in FIG. 1 for opening the drafting arrangements being shown in two operating positions.

A drafting arrangement opener 69 serves to open the drafting arrangement 11 via a valve (not shown) which controls the operation of a pneumatic cylinder 70 which is mounted on a swivel or pivot point on its rear end on the automatic robot 2. The valve for controlling cylinder 70 is similarly automatically operated by control unit 60. The cylinder 70 is preloaded against a stop 72 which opposes a spring 71. The stop 72 is preloaded in one direction with a spring 73 (stronger than spring 71) against a stop 74 fixedly mounted on the housing of the robot 2. The piston rod 75 projecting from the cylinder 70 is non rotatably mounted within cylinder 70 and has a head 76, which is represented in further detail in FIG. 2. A block 79 is pivotably connected via a peg 80 to a housing comprising portions 77, 78 which are screwed together. The block 79 is fixedly connected to such as by being screwed o to the piston rod 75. The housing 77. 78 can swivel or pivot relative to the block 79 on peg 80 between two stops 81, 82 and is preloaded via a spring 83 in a normal position as represented in FIG. 2. The two housing portions 77, 78 form a slot 84 therebetween running parallel to the piston rod 75 (when the housings 77, 78 are in their normal position as shown in FIG. 2) which is widened to a wedge against the free end. A flat spring 85 with a catch 86 is fixedly fitted or mounted between the parts 77, 78.

The sequence of operations for opening the drafting arrangement 11 is as follows. The piston rod 75 is pneumatically moved forwardly out of the retracted position represented in FIG. 1. The slot 84 thereby receives the pin 33, FIG. 2,. Subsequently, the front end 100 of the upper housing portion 78 engages the undersurface of the pawl 29 and pushes the pawl 29 into the position shown by the dashed lines in FIG. 2, such that the lever 27 is free, the pin 33 is snap fit behind catch 86, and, on a following return stroke, the piston rod 75 snaps into the position shown in FIG. 3. Through its own weight, working in conjunction with the spring 71, the housing 77, 78 tilts or pivots on peg 80 against the force of the spring 83, into the position shown in FIG. 3 in which the stop 82 engages the block 79. In this position, the upper side surface 88 of the housing portion 78 is nearly parallel to the underside surface of the pawl 29. With housing 77, 78 remaining in this downwardly pivoted position, piston rod 75 is then pneumatically moved outwardly again from its snapped-in position. The piston rod 75 is moved outwardly sufficient to return lever 27 to an upright position and, by virtue of housing 77, 78 being in a downwardly pivoted position relative to block 79, housing 78 does not contact the underside surface of pawl 29 which thus enables pawl 29 to pivot back downwardly and allow catch 31 to snap back into position behind the shoulder 32. The piston rod 75 is then moved backwardly or retracted into the piston 70. Upon retraction of piston rod 75, another piston 89, FIG. 2, provided in a pneumatic cylinder 90 built into housing portion 77 is simultaneously moved outwardly. The end of piston rod 91 pushes against the surface of lever 27 and effects a torque movement on the head 76 in a clockwise direction whereby lifting of the pawl 29 on the return stroke of the piston rod 75 is prevented.

Figure 3:
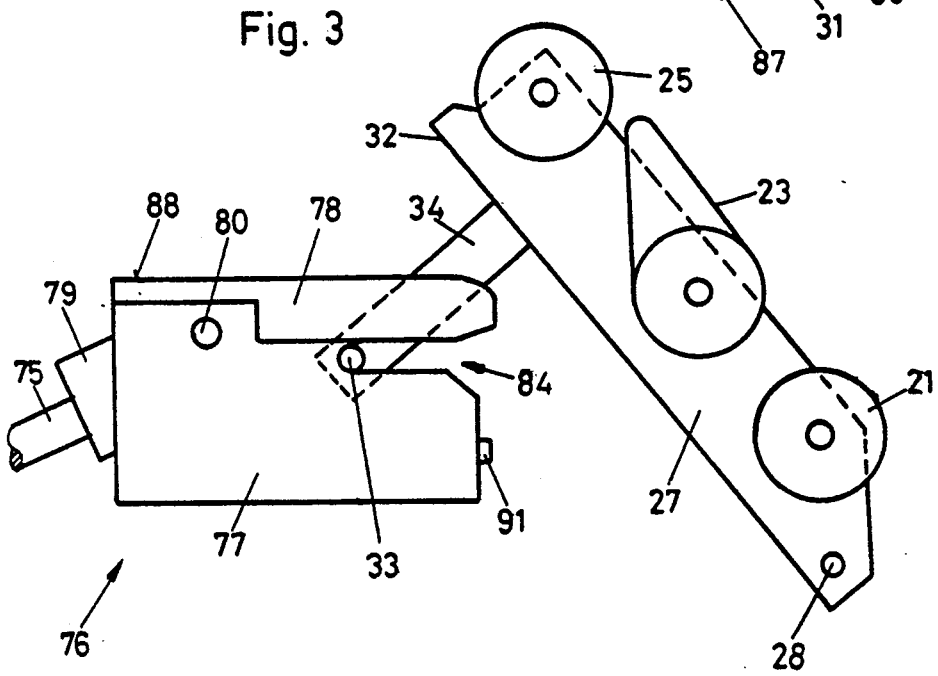

In an alternative exemplary embodiment, the spring 83 is omitted and two catching elements may be employed which secure the housing 77, 78 against the block 79 in the two limiting positions according to FIG. 2 and 3. In such an embodiment, the housing 77, 78 is swivelled into its normal position as shown in FIG. 2 upon the return stroke of the piston rod 75 back into the FIG. 1 starting position by use of a stop on the automatic device 2. This is possible because, in the position according to FIG. 3, the cylinder 70 is swivelled away from the stop 72 and the stop for the return swivelling of the housing 77, 78 can be arranged in such a way, that this stop cannot be reached in the position as shown in FIG. 3.

In a typical operation, the automatic device 2 works as follows: If a thread 102 break between nozzle 2 and spool 15 is detected at a spinning unit 3 by thread detector 13, then the automatic device 2 travels to a position in front of this spinning unit 3. Before the broken thread end is removed from spool 15 and pieced, the robot 2 carries out a cleaning cycle. The drafting arrangement 11 is opened by the opener 69 to the position represented in FIG. 3. The manipulator mechanisms 50, controlled by the program, successively moves the suction pipe 51 with its orifice **51*a* to selected critical positions on the spinning unit 3, which tend to collect fiber residues during operation, that is, for example, to one or more of the pair of delivery rollers 14, to the thread detector 13, to the air jet nozzle 12 and to the various rollers of the opened drafting arrangement 11. The valve 62 is controllably switched, typically automatically, into an operating mode whereby the hose 61 is connected directly with the suction pump 64 at least when the suction pipe 51 is cleaning those critical positions on the machine where cleaning suction force is not already being provided, e.q. at the positions of the rollers 14 and detector 13. As described above, when the valve 62 is in an operating position where the hose 61 is connected directly to pump 64, the suction source works more powerfully than it does when the valve 62 is in its first normal position where the suction effect of the pump 64 is reduced via the shutter 63. The valve 62 is typically programmably controlled to be in the normal reduced suction position during piecing (or spinning on) operations such as when a broken or cut thread end is picked up by pipe 51 to be routed through rollers 14 and eventually through the yarn passage of nozzles 12** for eventual joining with a sliver.

On the other hand, when the orifice 51*a* is positioned in the area of the air jet nozzle 12, the sliver delivery roller 24 and the drafting apron 22 during cleaning operations, the hose 61 is preferably connected with the pressurized air source 65 via programmed switching of the valve 62 into the third position. The air jet nozzle 12 is preferably blown out by the pipe 51, which may provide better cleaning relative to suctioning. The air jet nozzle 12 is preferably not only blown through the central yarn passage, e.q. from its outlet and toward its inlet, but is also typically blown out laterally through a slot 92 or spacing such as might exist where a nozzle system comprises two successive nozzles. In order to deflect air blowing out from the orifice 51*a* into the slot or spacing 92, a deflection guide plate 93 may be provided on one side of the air jet nozzle for facilitating the direction of pressurized air from orifice 51*a* therethrouqh.

For cleaning the air jet nozzle 12, it has additionally been shown to be advantageous as expedient when, after the drafting arrangement 11 has been closed, the drafting apparatus 11 is put into operation for a short period, e.q. for a few seconds, before an ultimate piecing or spinning on operation is initiated. A certain short length of the fiber sliver 95, FIG. 2, is thereby conveyed via the drafting arrangement 11 into the air jet nozzle 12. The thread thus emerging from the nozzle 12 is then sucked up by the suction installation 39, 40 or the suction pipe 51. Unlike the situation in normal spinning operations where tension is created in the thread, in part, by draw off engagement in rollers 35, 36, the thread spun in this short cleaning period of time lacks tension and the fiber current within the nozzle 12 runs differently than it does during normal spinning operation, such that the fiber residues within the nozzle 12 are sucked away which would otherwise remain during normal spinning operation.

A stop mechanism 96 is typically provided for controlling sliver feed to the drafting arrangement 11 during periods when the drafting arrangement is on or off. The stop 96 can be swivelled by means of a pneumatic cylinder from a normal sliver feed position as represented in FIG. 1 into a working sliver stop position shown in FIG. 2. The stop 96 has a wedge shaped nose 98, which can project into the feed gap area between the pair of back drafting arrangement rollers 20, 21. A fiber sliver conduit 99 merges with this nose 98. In the working position, the nose 98 lifts the roller 21 out of engagement with the driven roller 20 and simultaneously clamps the fiber sliver 95 between the nose 98 and the surface of the roller 21 such that the feed of the fiber sliver 95 to the drafting arrangement 11 is stopped.

Before piecing or start up or spinning on procedures are initiated for additional cleaning of the air jet nozzle, the stop 96 is typically swivelled into the normal position for a short period and subsequently swivelled back to the working position. This enables the drafting arrangement 11 to deliver a small amount of sliver for a short time as described above for supplemental cleaning purposes.

The full cleaning cycle described above is also preferably carried out at each spinning position 3 prior to starting up spinning machine 1 operations in the first instance and after bobbins are exchanged for fully threaded bobbins, that is to say, before spinning on operations. Depending on the amount of dirt or the frequency of thread breaks, it can be expedient to deliberately cause an artificial thread break at an individual station 3 from time to time, followed by an automatic cleaning cycle and piecing operation in response to the thread break.

When the cleaning cycle is finished, the thread is pieced or spun on to a new sliver by means of the same suction pipe 51 in conjunction with other operating mechanisms (not shown) of the automatic device 2, in a manner such as described in DE-C 33 36 294, the disclosure of which is incorporated herein by reference.

Piecing or spinning on operations are effected by essentially the same operation whereby a terminal spun thread end which has either been broken or cut is joined together with a new sliver. The terminal spun thread end is typically located on a spool or bobbin such as spool 15 as a result of a thread break (piecing) which occurs during normal spinning operation or on a new empty spool or bobbin which is placed on a spool or bobbin holder as a result of spool exchange operations or machine 1 start up. The terminal spun thread end to be joined with a new sliver must be routed from the spool or bobbin on which the thread end resides through various components of a spinning system such as rollers 14, detector 13 and nozzle 12 (or functionally similar elements in ring or cap spinning machines) and is typically eventually overlapped with the end of a new sliver somewhere within or near a drafting arrangement such as arrangement 11. As described above suction tube 51 participates in a variety of operations involved in piecing or spinning on or start spinning operations which result in the joining of a thread end with a sliver. Some of the typical thread joining operations which suction tube 51 and its associated manipulator 50 components perform are routing a broken thread end through rollers 14, delivering the thread end to another manipulator or mechanism which participates in thread joining operations, routing a broken thread through a spinning mechanism, through one or more of a pair of drafting arrangement rollers or aprons and the like.

It is clear that the cleaning cycle described above with the suction pipe 51 is likewise suitable for spinning machines other than air jet spinning machines, which require a suction pipe of the type described herein for threading, piecing or spinning on a thread. Examples of such spinning machines are a ring spinning machine or a cap spinning frame, as described, for example, in EP-A-O 225 660.

For this reason, in this application the term "fiber sliver" is used in its most general sense, which applies not only to a fibre sliver of approximately parallel fibers but also to a slubbing or a roving with a small amount of twist. The fibre sliver delivery is also suitable for a ring spinning or cap spinning frame or a similar drafting arrangement 11 to that represented in FIG. 1. The winding position there consists, however, of a tube put on a spindle, whereby the actual spinning arrangement is formed by the ring-traveller system with the ring spinning machine or by the cap with the cap spinning frame.

The air jet nozzle system 12 described herein can assume a variety of forms such as a single nozzle or more than one nozzle such as a pair of successive nozzles as described, for example, in co-pending U.S. patent application Ser. No. 07/573,637 filed Aug. 24, 1990, the disclosure of which is incorporated herein by reference.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. In a textile spinning apparatus comprising a spinning machine having a plurality of spinning stations, apparatus for automatically joining a thread and cleaning the machine comprising:

a tube mechanism which performs operations for effecting both cleaning and thread joining at a spinning station, means for routing a flow of air through the tube mechanism and controlling the rate of air flow through the tube mechanism;

first means for moving the tube mechanism to one or more selected thread joining positions on a spinning station including at least a position such that a thread end received and held within the tube mechanism via air suction flow through the tube mechanism;

second means for moving the tube mechanism to one or more waste accumulation positions on the spinning station separate from the thread joining positions such that the selected waste accumulation positions on the spinning station are cleaned via controlled air flow through the tube mechanism; and wherein the means for routing and controlling the air flow includes means for selectively adjusting the rate or air flow through the tube mechanism to a rate predetermined for each selected position to which the tube mechanism is moved.

2. Apparatus of claim 1 wherein the means for routing and controlling comprises a first source of lesser suction and a second source of greater suction alternatively connectable to the tube mechanism.

3. Apparatus of claim 1 wherein the first and second means for moving and the means for routing and controlling are connected to a program mechanism, the program mechanism including means for automatically directing the tube mechanism to be moved first between the selected waste accumulation positions according to a predetermined sequence and subsequently between the selected thread joining positions in a predetermined sequence.

4. Apparatus of claim 1 wherein the means for routing and controlling includes means for connecting the tube mechanism to a first lesser suction air flow when the tube mechanism is in the position for receipt of the thread end within the tube mechanism and means for connecting the tube mechanism to a second greater suction air flow when the tube mechanism is in selected thread waste positions.

5. Apparatus of claim 4 wherein the means for routing and controlling further includes means for connecting the tube mechanism to a source of pressurized air when the tube mechanism is in selected thread waste positions.

6. Apparatus of claim 1 wherein the tube mechanism is movable within at least two degrees of freedom.

7. Apparatus of claim 1 wherein the tube mechanism is mounted on a first mechanism movable along a direction approximately parallel with a selected yarn spinning axis.

8. Apparatus of claim 7 wherein the tube mechanism is mounted on a mechanism for pivoting the tube mechanism in a first degree of freedom.

9. Apparatus of claim 8 wherein the tube mechanism is mounted on a mechanism for pivoting the tube mechanism in a first degree of freedom.

10. Apparatus of claim 1 wherein the tube mechanism is mounted on a mechanism for pivoting the tube mechanism in a first degree of freedom.

11. Apparatus of claim 1 wherein the tube mechanism is movable within three degrees of freedom.

12. Apparatus of claim 1 wherein said first and said second means for moving the tube mechanism to the thread joining and thread waste positions are connected to a programmable control mechanism, the programmable control mechanism including mean for directing said first and said second means for moving to move the tube mechanism to the selected thread waste and thread joining positions in a preselected sequence.

13. Apparatus of claim 12 wherein the means for routing and controlling the air flow is connected to the programmable control mechanism, the programmable control mechanism further including means for directing the means for routing and controlling to adjust the rate of air flow to a rate predetermined for each of the positions to which the tube mechanism is moved.

14. In a textile spinning machine apparatus comprising a spinning machine, apparatus for automatically joining a thread and cleaning the machine comprising:

a tube mechanism, means for routing a flow of air through the tube mechanism and controlling the rate of air flow through the tube mechanism;

first means for moving the tube mechanism to one or more selected thread joining positions relative to the machine including at least a position such that a thread end received and held within the tube mechanism via air suction flow through the tube mechanism;

second means for moving the tube mechanism to one or more waste accumulation positions relative to the machine such that the selected waste accumulation positions on the machine are cleaned via controlled air flow through the tube mechanism; and wherein the means for routing and controlling the air flow includes means for selectively adjusting the rate of air flow through the tube mechanism to a rate predetermined for each selected position to which the tube mechanism is moved, and wherein the means for routing and controlling includes means for controlling the direction of air flow through the tube mechanism such that air is sucked in one direction when the tube mechanism is moved between the thread joining positions and blown in a reverse direction when the tube mechanism is moved to one or more of the waste accumulation positions.

15. In a textile spinning apparatus comprising a spinning machine, apparatus for automatically joining a thread and cleaning the machine comprising:

a tube mechanism, means for routing a flow of air through the tube mechanism and controlling the rate of air flow through the tube mechanism;

first means for moving the tube mechanism to one or more selected thread joining positions relative to the machine including at least a position such that a thread end received and held within the tube mechanism via air suction flow through the tube mechanism;

second means for moving the tube mechanism to one or more waste accumulation positions relative to the machine such that the selected waste accumulation positions on the machine are cleaned via controlled air flow through the tube mechanism; and wherein the means for routing and controlling the air flow includes means for selectively adjusting the rate of air flow through the tube mechanism to a rate predetermined for each selected position to which the tube mechanism is moved, and wherein the spinning machine includes a spinning mechanism and means for stopping and starting delivery of a sliver to the spinning mechanism, the stopping and starting means stopping sliver delivery prior to movement of the tube mechanism between the waste accumulation positions and starting sliver delivery after movement of the tube mechanism to one or more of the thread joining positions.

16. Apparatus of claim 15 wherein the means for routing and controlling further comprises a first source of lesser suction and a second source of greater suction alternatively connectable to the tube mechanism.

17. In a textile spinning machine comprising a plurality of spinning stations, having an automatic servicing apparatus mounted thereon for aligning with and servicing the spinning stations, wherein the servicing apparatus includes a tube mechanism connected to a mechanism for controllably directing an air flow therethrouqh, the tube mechanism being mounted on the servicing apparatus for controllable movement between selected positions relative to a spinning station, a method for performing thread joining and cleaning operations at a spinning station comprising:

aligning the servicing apparatus with a selected spinning station at which a thread end is to be joined;

moving the tube mechanism between one or more selected waste accumulation positions relative to the selected spinning station and simultaneously selecting an air flow through the tube mechanism such that the selected waste positions are cleaned; and moving the tube mechanism between one or more selected thread joining positions relative to the selected spinning station separate form waste accumulation positions and simultaneously selecting an air flow through the tube mechanism such that a thread end ma be received and held within the tube mechanism.

18. The method of claim 17 wherein the tube mechanism is successively moved between the waste accumulation and thread joining positions.

19. The method of claim 18 wherein the air flow selected during the moving between the one or more thread waste positions is a suction flow and is greater than the air flow selected during the moving between the one or more thread joining positions.

20. In a textile spinning machine comprising a plurality of spinning stations, having an automatic servicing apparatus mounted thereon for aligning with an servicing the spinning stations, wherein the servicing apparatus includes a tube mechanism connected to a mechanism for controllably directing an air flow therethrough, the tube mechanism being mounted on the servicing apparatus for controllable movement between selected positions relative to a spinning station, a method for performing thread joining and cleaning operations at a spinning station comprising:

aligning the servicing apparatus with a selected spinning station at which a thread end is to be joined;

moving the tube mechanism between one or more selected waste accumulation positions relative to the selected spinning station and simultaneously selecting an air flow through the tube mechanism such that the selected waste accumulation positions are cleaned; and moving the tube mechanism between one or more selected thread joining positions relative to the selected spinning station and simultaneously selecting an air flow through the tube mechanism such that a thread end may be received and held within the tube mechanism, wherein the selected spinning station includes an air jet spinning nozzle mechanism and means for controllably starting and stopping delivery of a sliver to the nozzle mechanism, the method further comprising stopping sliver delivery prior to the step of moving the tube mechanism between the waste positions, starting the sliver deliver during the step of moving the tube mechanism between the waste positions for a time sufficient to deliver a length of sliver through the nozzle mechanism and stopping the sliver delivery prior to the step of moving the tube mechanism between the thread joining positions.

21. The method of claim 20 wherein the air flow selected during the moving between the one or more waste accumulation positions is a suction flow and is greater than the air flow selected during the moving between the one or more thread joining positions.

22. The method of claim 20 further comprising moving the tube mechanism successively between the selected waste accumulation and thread joining positions according to a predetermined sequence.

23. The method of claim 22 further comprising adjusting the air flow to a rate predetermined for each thread waste and thread joining position according to the predetermined sequence of successive movements of the tube mechanism.

24. A mobile service robot for servicing spinning stations of a spinning machine having a plurality of the stations, each of the spinning stations performing a spinning operation, the robot comprising a tube mechanism which performs operations for effecting both cleaning and thread joining, the robot including means for applying a suction through the tube in order to generate a suction force at a mouth of the tube to draw a thread end into the tube and retain the thread end therein during manipulation by controlled movement of the tube, drive means controllably operable to manipulate the tube and a programmable control means connected to the drive means for directing the drive means to perform a predetermined sequence of tube movements adapted to find and take up a thread end at a predetermined location relative to a spinning station being serviced by the robot and to manipulate the thread end relative to the spinning station starting from the take up location to re-establish a spinning operation at the spinning station, the control means further directing the drive means to perform a predetermined sequence of movements adapted to locate the mouth of the tube at least one additional location on the spinning station different from the take-up location to remove waste material which accumulates during a spinning operation at the additional location by suction generated at the mouth of the tube.

25. A mobile service robot for servicing a plurality of spinning stations in a spinning machine; the robot comprising:

a tube mechanism which performs operations for effecting both cleaning and thread joining at a spinning station, the tube mechanism having a mouth and being connected to a source of air flow for generating a predetermined air flow through the mouth of the tube mechanism;

a drive mechanism programmed to control movement of the tube mechanism to a predetermined sequence of selected locations on a spinning station, the source of air flow being programmed to generate a rate and direction of air flow predetermined according to the location of the tube mechanism;

the predetermined sequence of tube locations including a series of thread end receipt locations on the spinning station including a location for finding a thread end on a bobbin and suctioning the thread end through the mouth into the tube mechanism and one or more other locations wherein the thread end is suctionably held within the tube mechanism, the movement of the tube mechanism between the series of thread end receipt locations manipulating the thread end such that the thread end is positioned for piecing;

the predetermined sequence of tube locations including one or more locations on the spinning station separate from the thread end receipt locations wherein the flow of air through the mouth is controlled to remove waste accumulated at the one or more separate locations on the spinning station.

26. A textile spinning apparatus comprising a plurality of spinning stations for performing a spinning operation and an automatic servicing apparatus controllably movable into alignment with a selected spinning station for servicing the selected spinning station upon a breakage of thread being spun at the selected spinning station;

each spinning station including a spinning mechanism and means for controllably starting and stopping delivery of a sliver to the spinning mechanism;

the automatic servicing apparatus including a tube mechanism which performs operations for effecting both cleaning and thread joining at the selected spinning station, the tube mechanism being connected to a source of air flow, first means for moving the tube mechanism between one or more selected waste accumulation positions on the selected spinning station, the waste accumulation positions accumulating waste during a spinning operation, second means for moving the tube mechanism between one or more selected thread joining positions on the selected spinning station separate from the waste accumulation positions, and means for controlling the rate and direction of air flow through the tube mechanism according to the position to which the tube mechanism is moved by the first and second means for moving.

27. The apparatus of claim 26 wherein the means for controlling includes means for controlling movement of the first means for moving between the one or more waste accumulation positions in a first predetermined sequence and means for controlling movement of the second means for moving between the one or more thread joining positions in a second subsequent predetermined sequence.

28. A textile spinning apparatus comprising a plurality of spinning stations and an automatic servicing apparatus controllably movable into alignment with a selected spinning station for servicing the selected spinning station upon a breakage of thread being spun at the selected spinning station;

each spinning station including a spinning mechanism and means for controllably starting and stopping delivery of a sliver to the spinning mechanism;

the automatic servicing apparatus including a tube mechanism connected to a source of air flow, first means for moving the tube mechanism between one or more selected waste accumulation positions relative to the selected spinning station, second means for moving the tube mechanism between one of more selected thread joining positions relative to the selected spinning station, and means for controlling the rate and direction of air flow through the tube mechanism according to the position to which the tube mechanism is moved by the first and second means for moving; wherein the means for controlling includes means for effecting suction air flow through the tube mechanism upon movement of the tube mechanism between the thread joining positions and means for effecting reverse air blowing flow through the tube mechanism upon movement of the tube movement to one or more of the waste accumulation positions.

29. The apparatus of claim 28 wherein the means for controlling includes means for controlling movement of the first means for moving between the one or more waste accumulation positions in a first predetermined sequence and means for controlling movement of the second means for moving between the one or more thread joining positions in a second subsequent predetermined sequence.

30. A textile spinning apparatus comprising a plurality of spinning stations and an automatic servicing apparatus controllably movable into alignment with a selected spinning station for servicing the selected spinning station upon a breakage of thread being spun at the selected spinning station;

each spinning station including a spinning mechanism and means for controllably starting and stopping delivery of a sliver to the spinning mechanism;

the automatic servicing apparatus including a tube mechanism connected to a source of air flow, first means for moving the tube mechanism between one or more selected waste accumulation positions relative to the selected spinning station, second means for moving the tube mechanism between one of more selected thread joining positions relative to the selected spinning station, and means for controlling the air flow through the tube mechanism according to the position to which the tube mechanism is moved by the first and second means for moving; and wherein the means for controlling effects movement of the first means for moving between the one or more waste accumulation positions in a first predetermined sequence and movement of the second means for moving between the one or more thread joining positions in a second subsequent predetermined sequence; and, wherein the means for starting and stopping sliver delivery stops sliver delivery prior to movement of the tube mechanism between the one or more waste accumulation positions and subsequently starts sliver delivery after movement of the tube mechanism between one or more of the waste accumulation positions for a time sufficient to deliver a length of sliver through the nozzle mechanism and subsequently stops sliver delivery prior to movement of the tube between the one or more thread joining positions.

31. A textile spinning apparatus comprising a plurality of spinning stations and an automatic servicing apparatus controllably movable into alignment with a selected spinning station for servicing the selected spinning station upon a breakage of thread being spun at the selected spinning station;

each spinning station including a spinning mechanism and means for controllably starting and stopping delivery of a sliver to the spinning mechanism;

the automatic servicing apparatus including a tube mechanism connected to a source of air flow, first means for moving the tube mechanism between one or more selected waste accumulation positions relative to the selected spinning station, second means for moving the tube mechanism between one of more selected thread joining positions relative to the selected spinning station, and means for controlling the air flow through the tube mechanism according to the position to which the tube mechanism is moved by the first and second means for moving; and wherein the spinning station includes a bobbin mechanism on which a broken thread end is wound up and retrieved for piecing, and wherein the means for stopping and starting sliver delivery stops sliver delivery prior to movement of the tube mechanism between the thread joining positions and starts sliver delivery subsequent to movement of the tube mechanism to one or more of the thread joining positions such that a new sliver is overlapped with the broken thread end retrieved from the bobbin mechanism.

32. In a textile spinning machine apparatus comprising a spinning machine, apparatus for automatically joining a thread and cleaning the machine comprising:

a tube mechanism, means for routing a flow of air through the tube mechanism and controlling the rate of air flow through the tube mechanism;

first means for moving the tube mechanism to one or more selected thread joining positions relative to the machine including at least a position such that a thread end received and held within the tube mechanism via air suction flow through the tube mechanism;

second means for moving the tube mechanism to one or more selected waste accumulation positions relative to the machine such that the selected waste accumulation positions on the machine cleaned via controlled air flow through the tube mechanism; and wherein the means for routing and controlling the air flow includes means for selectively adjusting the rate of air flow through the tube mechanism to a rate predetermined for each selected position to which the tube mechanism is moved by the means for moving; and, wherein the means for starting and stopping sliver delivery stops sliver delivery prior to movement of the tube mechanism between the one or more waste accumulation positions and subsequently starts sliver delivery after movement of the tube mechanism between one or more of the waste accumulation positions for a time sufficient to deliver a length of sliver through the nozzle mechanism and subsequently stops sliver delivery prior to movement of the tube between the one or more thread joining positions.

33. In a textile spinning machine apparatus comprising a spinning machine, apparatus for automatically joining a thread and cleaning the machine comprising:

a tube mechanism, means for routing a flow of air through the tube mechanism and controlling the rate of air flow through the tube mechanism;

first means for moving the tube mechanism to one or more selected thread joining positions relative to the machine including at least a position such that a thread end received and held within the tube mechanism via air suction flow through the tube mechanism;

second means for moving the tube mechanism to one or more selected waste accumulation positions relative to the machine such that the selected waste accumulation positions on the machine cleaned via controlled air flow through the tube mechanism; and wherein the means for routing and controlling the air flow includes means for selectively adjusting the rate of air flow through the tube mechanism to a rate predetermined for each selected position to which the tube mechanism is moved by the means for moving; and, wherein the spinning station includes a bobbin mechanism on which a broken thread end is wound up and retrieved for piecing, and wherein the means for stopping and starting sliver delivery stops sliver delivery prior to movement of the tube mechanism between the thread joining positions and starts sliver delivery subsequent to movement of the tube mechanism to one or more of the thread joining positions such that a new sliver is overlapped with the broken thread end retrieved from the bobbin mechanism.

* * * * *